US012140379B2

(12) United States Patent
Wei et al.

(10) Patent No.: US 12,140,379 B2
(45) Date of Patent: Nov. 12, 2024

(54) FLAT TUBE AND HEAT EXCHANGER

(71) Applicant: ZHEJIANG DUNAN ARTIFICIAL ENVIRONMENT CO., LTD., Zhejiang (CN)

(72) Inventors: Wenjian Wei, Zhejiang (CN); Wenyong Ma, Zhejiang (CN)

(73) Assignee: ZHEJIANG DUNAN ARTIFICIAL ENVIRONMENT CO., LTD., Zhejiang (CN)

( * ) Notice: Subject to any disclaimer, the term of this patent is extended or adjusted under 35 U.S.C. 154(b) by 256 days.

(21) Appl. No.: 17/417,390

(22) PCT Filed: Oct. 28, 2019

(86) PCT No.: PCT/CN2019/113741
§ 371 (c)(1),
(2) Date: Jun. 23, 2021

(87) PCT Pub. No.: WO2020/134491
PCT Pub. Date: Jul. 2, 2020

(65) Prior Publication Data

US 2022/0074670 A1 Mar. 10, 2022

(30) Foreign Application Priority Data

Dec. 26, 2018 (CN) ..... 201811604190.2

(51) Int. Cl.
*F28D 1/053* (2006.01)
*F28F 1/02* (2006.01)
(Continued)

(52) U.S. Cl.
CPC ..... *F28D 1/05366* (2013.01); *F28F 1/02* (2013.01); *F28F 1/426* (2013.01); *F28F 1/025* (2013.01);
(Continued)

(58) Field of Classification Search
CPC ..... F28F 1/025; F28F 3/044; F28F 9/0282; F28F 9/0268; F28D 1/05366; F28D 1/0341
See application file for complete search history.

(56) References Cited

U.S. PATENT DOCUMENTS 2,684,690 A * 7/1954 Lee ..... D21F 1/02 239/557
4,470,455 A * 9/1984 Sacca ..... F28F 3/042 165/166
(Continued)

FOREIGN PATENT DOCUMENTS

CN 1133430 A 10/1996
CN 1798951 A 7/2006
(Continued)

OTHER PUBLICATIONS

Translation of DE202010003080U1 entitled Translation-DE202010003080U1 (Year: 2023).*
(Continued)

*Primary Examiner* — Paul Alvare
(74) *Attorney, Agent, or Firm* — Samson G. Yu

(57) ABSTRACT

Some embodiments of the present disclosure provide a flat tube and a heat exchanger. The flat tube includes a middle tube segment and necking connection segments located at two ends of the middle tube segment, wherein a width of each of the necking connection segments is less than a width of the middle tube segment, a transition connection segment is provided between the each of the necking connection segments and the middle tube segment, and the transition connection segment is provided with a fastening and positioning part.

12 Claims, 3 Drawing Sheets

(51) Int. Cl.
*F28F 1/42* (2006.01)
*F28F 3/04* (2006.01)
*F28F 9/02* (2006.01)

(52) U.S. Cl.
CPC ..... *F28F 3/044* (2013.01); *F28F 9/0268* (2013.01); *F28F 9/0282* (2013.01)

(56) References Cited

U.S. PATENT DOCUMENTS 4,600,053 A * 7/1986 Patel ..... F28F 3/08 29/890.039
5,062,477 A * 11/1991 Kadle ..... F28D 1/0341 165/174
5,099,913 A * 3/1992 Kadle ..... B60H 1/00335 62/526
5,101,891 A * 4/1992 Kadle ..... F28F 3/04 165/152
5,111,878 A * 5/1992 Kadle ..... F28F 3/044 165/DIG. 465
5,211,222 A * 5/1993 Shinmura ..... F28D 1/035 165/176
5,409,056 A * 4/1995 Farry, Jr. ..... F28F 3/044 165/176
5,439,050 A * 8/1995 Waterman ..... F24H 8/00 165/170
5,620,047 A * 4/1997 Nishishita ..... F28D 1/0341 165/176
5,632,331 A * 5/1997 Shinmura ..... F28D 1/0341 165/176
5,996,633 A * 12/1999 Kato ..... F28F 3/042 138/116
6,073,688 A * 6/2000 Kato ..... F28F 9/0224 165/173
6,397,937 B1 * 6/2002 Ghiani ..... F28D 1/05366 165/DIG. 488
6,520,251 B2 * 2/2003 Shin ..... F28F 3/04 165/176
10,113,814 B2 * 10/2018 Persson ..... F28F 3/083
2001/0018970 A1 * 9/2001 Nakado ..... F28D 1/0316 165/173
2002/0139520 A1 * 10/2002 Pinto ..... F28D 1/0333 165/153
2003/0019618 A1 * 1/2003 Watanabe ..... F28F 3/04 165/173
2006/0162911 A1 * 7/2006 Oh ..... F28F 9/0282 165/176
2006/0231241 A1 * 10/2006 Papapanu ..... F28F 13/06 165/152
2006/0249281 A1 * 11/2006 Park ..... F28F 9/0282 165/176
2008/0066893 A1 * 3/2008 Oh ..... F28D 1/0341 165/174
2008/0110608 A1 * 5/2008 Gorbounov ..... F28F 9/185 165/173
2009/0188655 A1 7/2009 Agee
2011/0107512 A1 * 5/2011 Gilbert ..... E03C 1/00 4/596
2012/0018128 A1 * 1/2012 Chang ..... F28F 3/048 165/104.19
2013/0213623 A1 * 8/2013 Perocchio ..... F28F 1/022 165/170
2013/0276305 A1 * 10/2013 Nissen ..... F28F 21/084 29/890.043
2014/0318754 A1 * 10/2014 Vallee ..... F28D 1/0325 165/166
2018/0054924 A1 2/2018 Zill et al.
2018/0216892 A1 * 8/2018 Kaneko ..... F28F 1/025
2020/0072561 A1 * 3/2020 Eijima ..... F28F 9/0075

FOREIGN PATENT DOCUMENTS

CN 103424014 A 12/2013
CN 103424024 A 12/2013
CN 204255159 U 4/2015
CN 104807361 A * 7/2015 ..... F28D 9/005
CN 305403380 S 10/2019
CN 115183609 A * 10/2022
DE 4009780 A1 10/1991
DE 19543234 A1 * 5/1996 ..... F28D 1/0341
DE 202010003080 U1 * 7/2010 ..... F28D 9/005
EP 0519334 A2 12/1992
EP 646759 A1 * 4/1995 ..... F28D 1/0341
FR 2962200 A1 * 1/2012 ..... F28F 1/022
FR 2989766 A1 * 10/2013 ..... F28F 1/02
JP 02022041 A * 1/1990 ..... B29C 49/0047
JP H07303930 A 11/1995
JP 08170893 A * 7/1996 ..... F28D 1/0341
JP 08271177 A * 10/1996 ..... F28D 1/0341
JP H1019494 A 1/1998
JP 2000061622 A * 2/2000 ..... B23K 1/0012
JP 2000346576 A * 12/2000 ..... F28D 1/0316
JP 2001050687 A * 2/2001
JP 2001263983 A * 9/2001 ..... F28D 1/05366
JP 2017089927 A * 5/2017
WO WO-2004106835 A2 * 12/2004 ..... F28D 1/0341
WO WO-2012001759 A1 * 1/2012 ..... B01J 19/0053

OTHER PUBLICATIONS

Translation of WO2012001759A1 named Translation-WO2012001759A1 (Year: 2024).*

* cited by examiner

FLAT TUBE AND HEAT EXCHANGER

CROSS-REFERENCE TO RELATED APPLICATIONS

The present disclosure is a national stage application of International Patent Application No. PCT/CN2019/113741, which is filed on Oct. 28, 2019, and claims priority to Chinese Patent Application No. 201811604190.2, filed on Dec. 26, 2018 and entitled "Flat Tube and Heat Exchanger", the contents of which are hereby incorporated by reference in its entirety.

TECHNICAL FIELD

The present disclosure relates to a technical field of heat exchange devices, and in particular, to a flat tube and a heat exchanger.

BACKGROUND

Currently, a bump structure is provided in a flat tube of a heat exchanger known to inventors, and the bump structure has a certain turbulence effect on a fluid medium in the flat tube.

The flat tube known to inventors is formed by stamping and butt welding of two composite aluminum plates; the flat tube is necked, which significantly reduces a size of a header, reduces a internal volume of the heat exchanger, and reduces a filling of a refrigerant; there is no large welding spot to reinforce a port, and a strength of a straight welding edge is weak; and a welding spot in a middle portion is further optimized, so as to improve a strength and a heat exchange efficiency.

SUMMARY

The main object of the present disclosure is to provide a flat tube and a heat exchanger, so as to solve a problem of a low strength of flat tubes known to inventors.

In order to achieve the described object, some embodiments of the present disclosure provide a flat tube. The flat tube includes a middle tube segment and necking connection segments located at two ends of the middle tube segment, wherein a width of each of the necking connection segments is less than the width of the middle tube segment, a transition connection segment is provided between the each of the necking connection segments and the middle tube segment, and the transition connection segment is provided with fastening and positioning parts.

In some embodiments, the flat tube includes two metal sheets, and the fastening and positioning part is formed by welding the two metal sheets.

In some embodiments, the fastening and positioning part is formed by welding bumps of the two metal sheets.

In some embodiments, the fastening and positioning part has a long strip-shaped structure, there are a plurality of the fastening and positioning parts, and the plurality of the fastening and positioning parts are arranged at an interval in a width direction of the transition connection segment.

In some embodiments, a distance between two adjacent fastening and positioning parts in the plurality of the fastening and positioning parts gradually widens in a direction from being the each of the necking connection segments to the middle tube segment.

In some embodiments, a connecting line of end portions of the plurality of fastening and positioning parts on a side close to the each of the necking connection segments is of an arc, and a connecting line of end portions on a side away from the each of the necking connection segments is a straight line.

In some embodiments, the two metal sheets are both provided with protrusions protruding towards each other, tops of the protrusions on the two metal sheets are welded and fixed to form an auxiliary connection part, and the protrusions are all located on the middle tube segment.

In some embodiments, a welding area of the fastening and positioning part is larger than a welding area of the tops of the protrusions.

In some embodiments, there are a plurality of the protrusions, and the plurality of protrusions are arranged in a fish scale shape.

In some embodiments, depression bars are provided on two sides of the metal sheets extending in a length direction, the two metal sheets are welded and fixed together by means of the depression bars, a side edge of each depression bar close to the center of the flat tube is a concave-convex edge, and a side edge of the each depression bar away from the center of the flat tube is a straight edge.

In some embodiments, the concave-convex edge is a serrated edge or a corrugated side edge.

Some embodiments of the present disclosure provide a heat exchanger, including a flat tube, wherein the flat tube is the flat tube described above.

By applying the technical solution of the present disclosure, since the transition connection segment of the flat tube in the present disclosure is provided with fastening and positioning part, the fastening and positioning part achieves a effect of local reinforcement, so that it is ensured that a joint between an end portion of the flat tube and a header slot withstands a high pressure, satisfying a pressure resistance requirement of heat exchangers in the refrigeration industry.

BRIEF DESCRIPTION OF THE DRAWINGS

The drawings, constituting a part of the present disclosure, are used for providing further understanding of the present disclosure, and the illustrative embodiments of the present disclosure and illustrations thereof are used for explaining the present disclosure, rather than constituting inappropriate limitation on the present disclosure. In the drawings.

Wherein the drawings include the following reference signs:

10. middle tube segment; 20. necking connection segment; 21. protrusion; 30. transition connection segment; 31. fastening and positioning part; 40. depression bar; 41. concave-convex edge; 42. straight side; and 50. collecting pipe.

DETAILED DESCRIPTION OF THE EMBODIMENTS

It should be noted that the embodiments and the features in the embodiments of the present disclosure can be combined without conflicts. The present disclosure will be described below with reference to the drawings and embodiments in detail.

It should be noted that the terminologies used herein are for the purpose of describing the embodiments only and are not intended to limit the exemplary embodiments according to the present disclosure. As used herein, the singular forms are intended to include the plural forms as well, unless the context clearly indicates otherwise. In addition, it should also be understood that the terminologies "include" and/or "comprise" when used in the present description indicate the presence of features, steps, operations, devices, components and/or a combination thereof.

Figure 1:
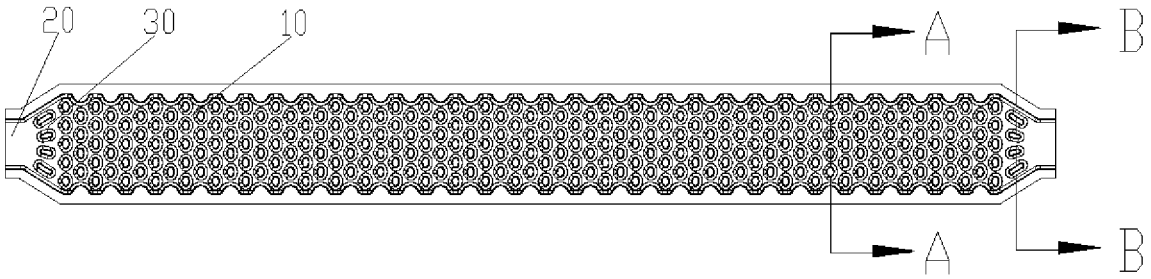
FIG. 1 illustrates schematically a front view of a flat tube of the present disclosure.
Figure 2:
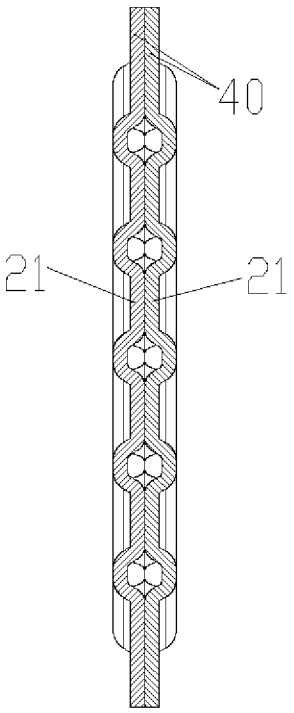
FIG. 2 illustrates schematically a view in A-A direction of FIG. 1 of a flat tube of the present disclosure.
Figure 3:
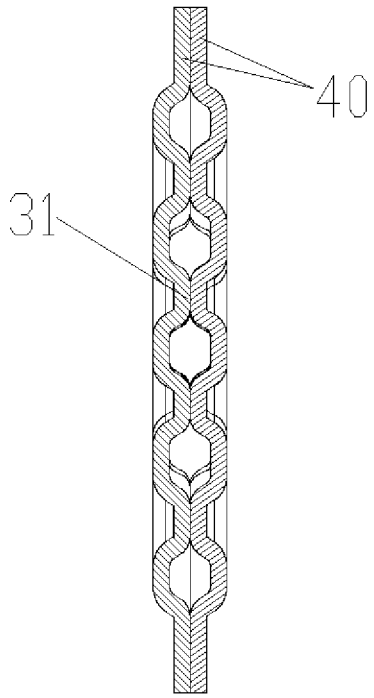
FIG. 3 illustrates schematically a view in B-B direction of FIG. 1 of a flat tube of the present disclosure.
Figure 4:
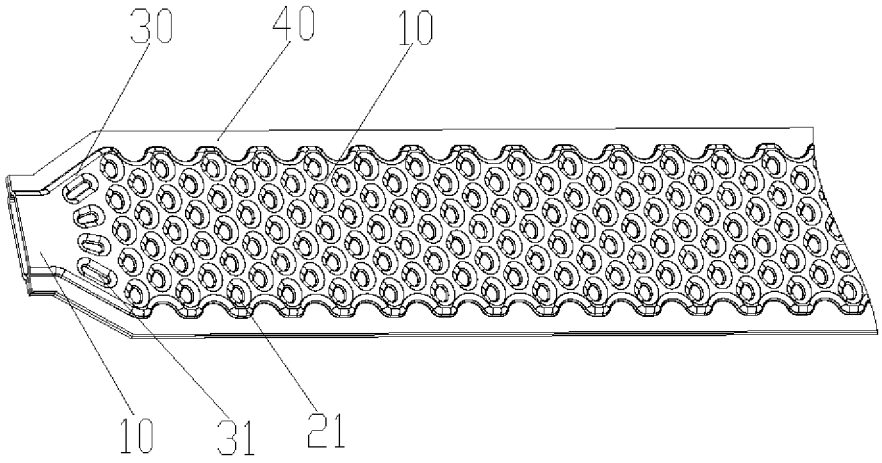
FIG. 4 illustrates schematically a partial view of a flat tube of the present disclosure.
Figure 5:
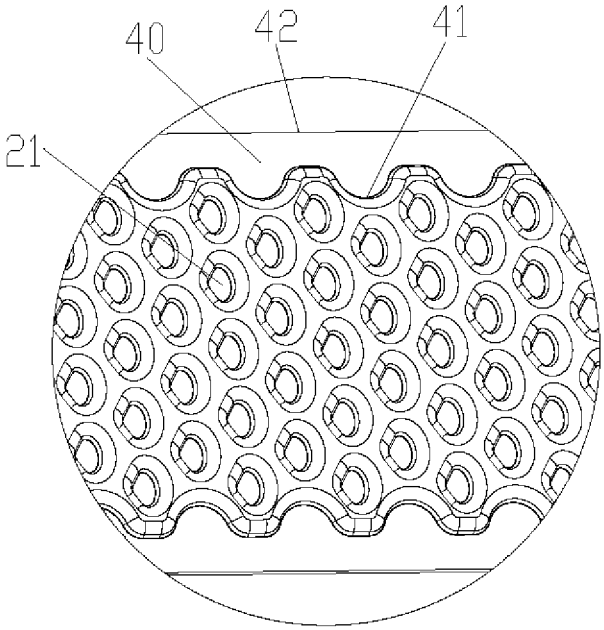
FIG. 5 illustrates schematically an enlarged view of a flat tube of the present disclosure.
Figure 6:
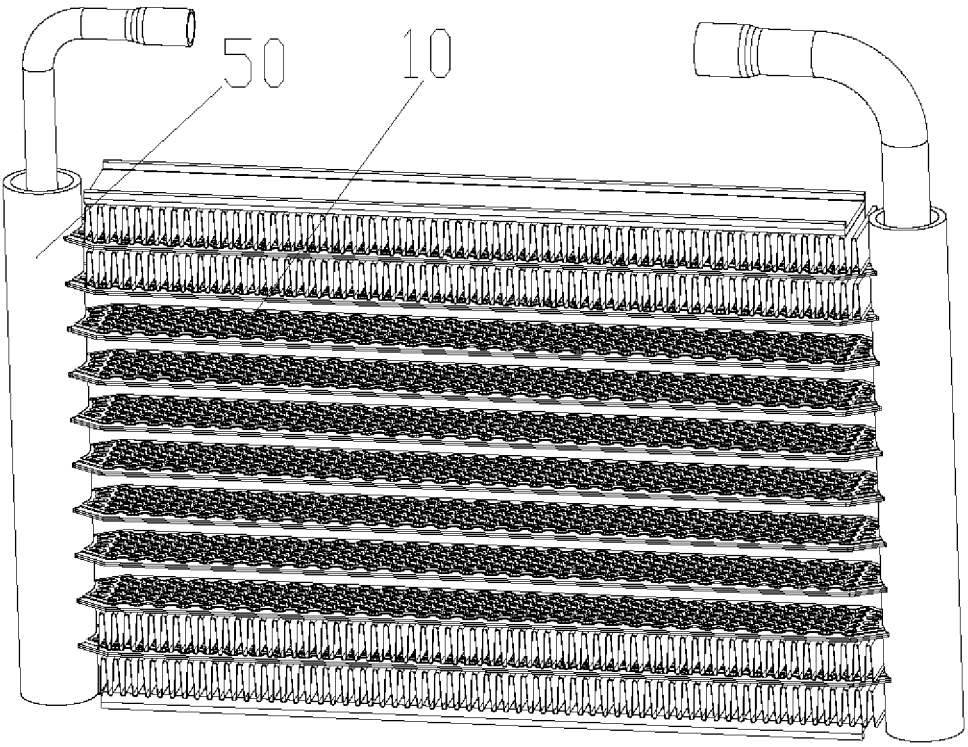
FIG. 6 illustrates schematically a perspective view of a heat exchanger of the present disclosure.

Referring to FIG. 1 to FIG. 6, according to an embodiment of the present disclosure, some embodiments of the present disclosure provide a heat exchanger. The heat exchanger includes flat tubes and collecting pipes 50, wherein the plurality of flat tubes are arranged side by side, and two ends of each flat tube are connected with the collecting pipes 50 respectively.

In order to improve a structural stability of a flat tube, the structure of the flat tube is improved in the present embodiment. The flat tube includes a middle tube segment 10 and necking connection segments 20 located at two ends of the middle tube segment 10, wherein a width of each of the necking connection segments 20 is less than the width of the middle tube segment 10, a transition connection segment 30 is provided between the each of the necking connection segments 20 and the middle tube segment 10, and the transition connection segment 30 is provided with a fastening and positioning part 31.

Since the transition connection segment 30 of the flat tube in the present embodiment is provided with the fastening and positioning part 31, the fastening and positioning part 31 can achieve the effect of local reinforcement, so that it can be ensured that a joint between an end portion of the flat tube and a slot of collecting pipe 50 can withstand a high pressure, satisfying a pressure resistance requirement of heat exchangers in the refrigeration industry.

The flat tube in the present embodiment includes two metal sheets, and the fastening and positioning part 31 is formed by welding the two metal sheets. Certainly, in other embodiments of the present disclosure, the two metal sheets are fixed together by means of pins or screws, and other variations as long as capable of improving a structural strength of the transition connection segment 30 all fall within a scope of protection of the present disclosure. Ins some embodiments, the fastening and positioning part 31 in the present embodiment is formed by welding bumps of the metal sheets, which have a simple structure and are easy to implement.

In the present embodiment, depression bars 40 are provided on two side edges of the two metal sheets extending in a length direction, correspondingly, the depression bars 40 of the two metal sheets are welded and fixed together, a side edge of each depression bar 40 close to the center of the flat tube is a concave-convex edge 41, and a side edge of the each depression bar 40 away from the center of the flat tube is a straight edge 42. Under an effect of the depression bars 40 and an effect of the concave-convex edge 41, an increasing of a weldable area of the flat tube is facilitated, the sealing performance of the heat exchanger after the welding of the flat tube is ensured, and the effect of reinforcing the edge portion is also achieved, so that the pressure bearing capabilities of the flat tube itself and the heat exchanger can be significantly improved, satisfying the pressure resistance requirement of heat exchangers in the refrigeration industry.

In addition, a design of the concave-convex edge 41 can also realize the turbulence purpose for the refrigerant in the flat tube.

In some embodiments, the concave-convex edge 41 in the present embodiment is a serrated side edge or a corrugated side edge, which facilitates increasing the weldable area of the flat tube, and is simple in structure and easy to implement. Certainly, in other embodiments of the present disclosure, the concave-convex edge 41 is configured to be a combination of the serrated side edge and the corrugated side edge or other concave-convex side edge, and other variations as long as under the concept of the present disclosure all fall within the scope of protection of the present disclosure.

In the present embodiment, the two metal sheets are both provided with protrusions 21 protruding towards each other, tops of the protrusions 21 on the two metal sheets are welded and fixed to form an auxiliary connection part, and the protrusions 21 are all located on the middle tube segment 10. Under the effect of the auxiliary connection part, the structural stability of the flat tube in the present embodiment can be further improved, and it is ensured that the flat tube can satisfy the pressure bearing requirement of heat exchangers.

A welding area of the fastening and positioning parts 31 in the present embodiment is greater than a welding area of the tops of the protrusions 21, which can effectively improve the structural strength of the two ends of the flat tube and ensure the connection strength between the flat tube and the collecting pipe 50.

In some embodiments, the fastening and positioning parts 31 in the present embodiment have a long strip-shaped structure, there are a plurality of the fastening and positioning parts 31, and the plurality of the fastening and positioning parts 31 are arranged at an interval in a width direction of the transition connection segment 30, which can achieve a flow guide effect, optimize the distribution of refrigerant inlets, ensure that the refrigerant is uniformly distributed in the longitudinal section of the flat tube, and utilize the heat exchange area of the flat tube to the maximum extent, thereby improving the heat exchange efficiency of the heat exchanger.

A distance between two adjacent fastening and positioning parts 31 in the plurality of the fastening and positioning parts gradually widens in a direction from being the each of the necking connection segments 20 to the middle tube segment 10, facilitating the uniform distribution of the refrigerant. In an embodiment of the present disclosure, a connecting line of end portions of the plurality of fastening and positioning parts 31 on a side close to the each of the necking connection segments 20 is of an arc, and a connecting line of end portions on a side away from the each of the necking connection segments 20 is a straight line.

In some embodiments, in other embodiments of the present disclosure, a plurality of long strip-shaped structures are arranged in a fan shape, facilitating guiding the refrigerant uniformly into the middle tube segment 10.

Referring to FIG. 1 to FIG. 4, there are a plurality of the protrusions 21 in the present embodiment, and the plurality of protrusions 21 are arranged in a fish scale shape. Compared with a circularly arranged structure, the plurality of protrusions 21 arranged in a fish scale shape in the present embodiment have a more compact structure, utilize the space more sufficiently, and can further improve the structural strength of the flat tube. In addition, the pressure angle in an inflow direction is small, so that the flowing resistance of the refrigerant can be reduced, and the primary heat exchange area is increased, so that the heat exchange can be enhanced.

From the description above, it can be determined that the embodiments above of the present disclosure achieve the following technical effects:

the end portion of the flat tube in the present disclosure is provided with waist-shaped large welding spots, which can achieve the effect of local reinforcement, so that it is ensured that the joint (usually a weak link) between the end portion of the flat tube and a collecting pipe slot can withstand a high pressure; the edge portion of the flat tube is provided with a concave-convex edge, which can increase the welding area, and ensure the sealing performance of the heat exchanger after welding, and also have the effect of reinforcing the edge portion, so that the pressure bearing capabilities of the flat tube itself and the heat exchanger can be significantly improved, satisfying the pressure resistance requirement 13.5 MPa of heat exchangers in the refrigeration industry;

in addition, the waist-shaped large spots can achieve a flow guide effect, optimize the distribution of refrigerant inlets, ensure that the refrigerant is uniformly distributed in the longitudinal section of the flat tube, and utilize the heat exchange area of the flat tube to the maximum extent, thereby improving the heat exchange efficiency of the heat exchanger;

the protrusions in the middle portion of the flat tube have a bionic structure (fish scale shape), and compared with the prior art (circular welding spot), the welding spots are arranged more compactly, the space is utilized more sufficiently, and the strength can be improved; furthermore, the pressure angle in an inflow direction is small, so that the flowing resistance of the refrigerant can be reduced; and the heat exchange area can be increased, so that the heat exchange can be enhanced.

The foregoing descriptions are merely preferred embodiments of the present disclosure, and are not intended to limit the present disclosure. For those skilled in the art, the present disclosure may have various modifications and variations. Any modifications, equivalent replacements, improvements, etc. made in line with the spirit and principle of the present disclosure shall be included in the scope of protection of the present disclosure.

What is claimed is:

1. A flat tube, comprising a middle tube segment and necking connection segments located at adjacent two lateral ends of the middle tube segment, wherein a width of each of the necking connection segments is less than a width of the middle tube segment, a transition connection segment is provided between the each of the necking connection segments and the middle tube segment; and a width of the transition connection segment gradually decreases along an extension direction from the middle tube segment to the necking connection segments;

wherein the flat tube further comprises a fastening and positioning part, and the fastening and positioning part is disposed in the transition connection segment;

wherein the fastening and positioning part has a strip-shaped structure, both ends of the fastening and positioning part are located within the transition connection segment, an extension direction of the fastening and positioning part is inclined to an extension direction of the middle tube segment;

wherein the flat tube comprises two metal sheets, and the fastening and positioning part is formed by welding bumps of the two metal sheets;

wherein the two metal sheets are both provided with protrusions protruding towards each other, tops of the protrusions on the two metal sheets are welded and fixed to form an auxiliary connection part, and the protrusions are all located on the middle tube segment;

wherein a welding area of the fastening and positioning part is larger than a welding area of a top of each of the protrusions.

2. The flat tube according to claim 1, wherein there are a plurality of the fastening and positioning parts, and the plurality of the fastening and positioning parts are arranged at an interval in a width direction of the transition connection segment.

3. The flat tube according to claim 2, wherein a distance between two adjacent fastening and positioning parts in the plurality of the fastening and positioning parts gradually widens in a direction from each of respective necking connection segments to the middle tube segment.

4. The flat tube according to claim 2, wherein a connecting line of end portions of the plurality of fastening and positioning parts on a side close to the each of the necking connection segments is of an arc, and a connecting line of end portions on a side away from the each of the necking connection segments is a straight line.

5. The flat tube according to claim 1, wherein there are a plurality of protrusions, and the plurality of protrusions are arranged in a fish scale shape.

6. The flat tube according to claim 1, wherein depression bars are provided on two sides of the metal sheets extending in a length direction, the two metal sheets are welded and fixed together by means of the depression bars, a side edge of each depression bar close to a center of the flat tube is a concave-convex edge, and a side edge of the each depression bar away from the center of the flat tube is a straight edge.

7. The flat tube according to claim 6, wherein the concave-convex edge is a serrated edge or a corrugated side edge.

8. A heat exchanger, comprising a flat tube, wherein the flat tube is the flat tube according to claim 1.

9. The heat exchanger according to claim 8, there are a plurality of the fastening and positioning parts, and the plurality of the fastening and positioning parts are arranged at an interval in a width direction of the transition connection segment.

10. The heat exchanger according to claim 9, wherein a distance between two adjacent fastening and positioning parts in the plurality of the fastening and positioning parts gradually widens in a direction from being close the each of the necking connection segments to the middle tube segment.

11. The heat exchanger according to claim 9, wherein a connecting line of end portions of the plurality of fastening and positioning parts on a side close to the each of the necking connection segments is of an arc, and a connecting line of end portions on a side away from the each of the necking connection segments is a straight line.

12. The heat exchanger according to claim 8, wherein there are a plurality of protrusions, and the plurality of protrusions are arranged in a fish scale shape.

* * * * *